United States Patent [19]

Zingg

[11] Patent Number: 4,644,974

[45] Date of Patent: Feb. 24, 1987

[54] CHOKE FLOW BEAN

[75] Inventor: Warren M. Zingg, Tulsa, Okla.

[73] Assignee: Dowell Schlumberger Incorporated, Tulsa, Okla.

[21] Appl. No.: 665,205

[22] Filed: Oct. 26, 1984

Related U.S. Application Data

[63] Continuation of Ser. No. 185,061, Sep. 8, 1980, abandoned.

[51] Int. Cl.[4] ..... E21B 41/00; F15D 1/02

[52] U.S. Cl. ..... 138/44; 138/40; 166/91

[58] Field of Search ..... 138/46, 44, 45, 40; 166/91

[56] References Cited

U.S. PATENT DOCUMENTS

| | | | |
|---|---|---|---|
| 1,867,876 | 7/1932 | Clark | 138/44 |
| 2,074,690 | 3/1937 | Gerts | 138/44 |
| 2,213,812 | 9/1940 | Harper et al. | 138/44 |
| 2,501,593 | 3/1950 | Becker | 138/44 |
| 2,795,931 | 6/1957 | Foll | 138/44 X |
| 3,145,529 | 8/1964 | Maloof | 138/44 |
| 3,170,289 | 2/1965 | Kramer | 138/44 X |
| 3,687,493 | 8/1972 | Lock et al. | 138/44 X |

FOREIGN PATENT DOCUMENTS

| | | | |
|---|---|---|---|
| 111893 | 12/1917 | United Kingdom | 138/44 |
| 153392 | 11/1920 | United Kingdom | 138/44 |

*Primary Examiner*—Allan N. Shoap
*Attorney, Agent, or Firm*—L. Wayne White

[57] ABSTRACT

A choke flow bean is described which is unusually effective in reducing the pressure of fluids flowing through it. The choke flow bean has a well rounded circular or eliptical throat which opens smoothly and directly into a divergent truncated exit cone having a divergent angle of from about 4° to about 8°. The length of the truncated exit cone can be up to about 9 times the throat diameter. The outer surface of the choke flow bean is usually cylindrical in shape with external threads at the discharge end and a wrench fitting (e.g., hex-nut type) at the inlet end. The choke flow bean is usually embodied within the casing of a choke nipple with the assistance of choke adaptor.

2 Claims, 4 Drawing Figures

CHOKE FLOW BEAN

This application is a continuation of Ser. No. 185,061, filed Sept. 8, 1980, now abandoned.

BACKGROUND OF THE INVENTION

1. Field of the Invention

This invention pertains to a novel choke flow bean and a choke nipple assembly containing an adaptor and the choke flow bean.

2. Description of the Prior Art

A wide variety of mechanical devices have been used to control the flow of fluids (liquids and/or gases) through a pipe. The various engineers handbooks describe various orifices, nozzles, and short tubes as means for reducing pressure of a fluid. See, for example, *Chemical Engineers Handbook,* 5th Edition, by R. H. Perry et al., McGraw-Hill Book Company (1973) and *Unit Operations of Chemical Engineering,* 3rd Edition, by W. L. McCabe et al., McGraw-Hill, Inc. (1976).

These handbooks show or describe a variety of "Venturi nozzles" where the fluid passes through a converging truncated cone into usually a short, straightwalled tube from which it is discharged into a diverging truncated cone, often called a diffuser. See, for example, the disclosure by McCabe et al., supra, at pages 203,212.

In other instances, simple flow nozzles have been used to regulate the flow of fluids. Nozzles with a well-rounded throat generally have a higher average coefficient of discharge than orifices having a square edge or a thin plate with a sharp edge. Flow measurements through such nozzles are described in Chapter 14 of the text, "Mechanical Measurements", by T. G. Beckwith et al., Addison-Wesley Publishing Company (1973), at pages 417–419.

The flow of fluids through convergent-divergent nozzles (DeLaval nozzles) has also been studied and is reported, for example, by R. H. Perry, supra, at pages 5–29 et seq. None of the DeLaval-type nozzles have been used, so far as the applicant knows, as a choke flow bean capable of handling fluids with entrained particulate solids.

SUMMARY OF THE INVENTION

A novel choke flow bean has now been discovered which is unusually effective in reducing the pressure of fluids flowing through it. The choke flow bean is also capable of handling fluids having entrained particulate solids.

The novel choke flow bean comprises:

a housing having a first end and second end defining a bore of generally circular cross section which extends, along with its axis of generation, from the first end to the second end, the bore being of varying diameter along its axis of generation with regions of large diameter adjacent the first and second ends of the housing a region of minimum diameter, d, intermediate the first and second ends, the bore having a general configuration approximating that of a trumpet bell between the first end and the region of minimum diameter, the bore having a frustoconical configuration between the first end and the region of minimum diameter with a total included angle of from about 4° to about 8° and having a length along the axis of generation of up to about 9d between the region of minimum diameter and the second end.

BRIEF DESCRIPTION OF THE DRAWINGS

In FIG. 1, the novel choke flow bean is shown as a housing having a generally cylindrical shape with a bore traversing from a first end to a second end. The bore is of generally circular cross-section and has an axis of generation from the first to the second end. The bore of varying diameter along its axis with regions of large diameter adjacent the first and the second ends. The throat portion of the bore has a general configuration approximating that of a trumpet bell (10) between the first end and the region of minimum diameter (11) having a diameter, d. The bore has a frustoconical configuration (12) between the second end and the region of minimum diameter with a total included angle, $\alpha$, of from about 4° to about 8° (preferably from about 5° to about 7°; more preferably, about 5°) and having a length, 1, along the axis of generation of up to about 9 d. When 1 is less than about 9 d, the pressure in the fluid is not reduced as much as it might be as it passes through the choke flow bean. If 1 is greater than about 9 d, the fluid passing through the choke flow bean experiences considerable turbulance as the fluid begins to fall away from the sides of the choke flow bean.

Figure 2:
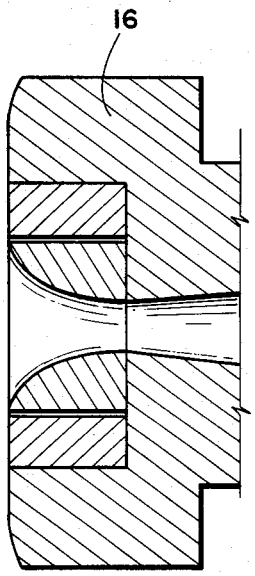
FIG. 2 shows a side schematic cross-sectional view of the choke flow bean which emphasizes the details of the throat and shows it in an embodiment where the throat portion is an insert.

The choke flow bean may be prepared from substantially any material of construction, but because it is exposed generally to high pressures during conditions of use, it is normally constructed of metal (usually steel) and in most instances it is prepared from materials noted for their toughness and abrasion resistance (e.g., tungsten carbide or carburized steel). The throat portion (10) is more subject to abrasion than the frustoconical portion (12). It is, therefore, convenient and usually preferred to construct the throat separately from the remainder of choke flow and to include an insert in the bean which contains the throat portion. This embodiment is illustrated in FIG. 2. The use of an insert permits the skilled artisan to use materials of construction which may be more critical to the particular application and also permits the artisan to more effectively utilize the metallurgy of the two different types of metals. For example, the throat portion could be an insert of tungsten carbide and the remainder of the choke flow bean could be of carburized steel which is far less expensive and easier to machine.

The radius of curvature of the throat portion (10) can be varied but is usually at least about 0.5 d (preferably from about 0.5 d to about 1.0 d) when circular or eliptical in shape. This well-rounded opening at the throat permits maximum flow through the choke flow bean and eliminates the formation of a vena contracta. This is important because as the choke flow bean flows full, the void spaces associated with a vena contracta do not form and cause the fluids passing through the choke flow bean to "hammer" and cavitate.

The throat portion passes through the region of minimum diameter (11) and opens smoothly and directly into the portion of frustoconical configuration (12). The total included angle in the frustoconical configuration, as noted above, is most preferably about 5°, and its length (1) is most preferably about 9 d.

Figure 4:
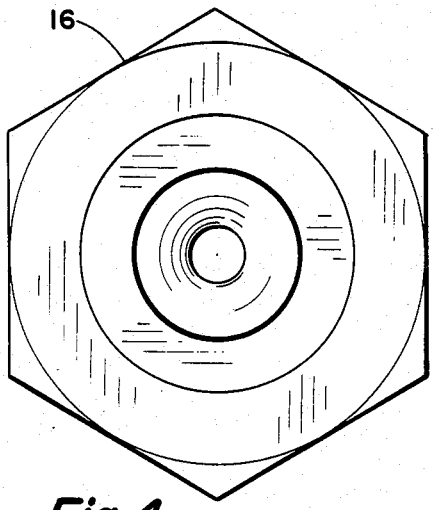
FIG. 4 is an end schematic cross-sectional view of the choke flow bean showing the external portion of the first end as a wrench-engaging fitting (i.e., a hex nut type).

The outer surface of the choke flow bean can be varied to convenience but is generally cylindrical in shape with external threads fashioned at the discharge end (B). These external threads are adapted to engage a choke adapter which holds the choke flow bean in place during conditions of use. The inlet end of the choke flow bean (A) usually has a configuration adapting it to removal or emplacement within the choke adapter using a conventional open-ended wrench (i.e., a wrench-engaging fitting). For example, FIG. 4 shows the inlet end of the choke flow bean shaped like a hex-head nut.

The choke adapter (13) is also usually of cylindrical shape, although it could take on different configurations. The choke adapter shown in FIG. 3 has internal threads to engage the choke flow bean, and has external threads to engage a choke nipple (14). The choke adapter is primarily a convenient spacing device that holds the choke flow bean firmly within the bore of the choke nipple. The choke adapter usually has a wrench-engaging fitting at the inlet end and a hollow cylindrical bore at the discharge end to receive depressurized fluids passing through the flow bean. The choke adapter can be of various materials of construction, but it is usually metal (generally steel).

Figure 3:
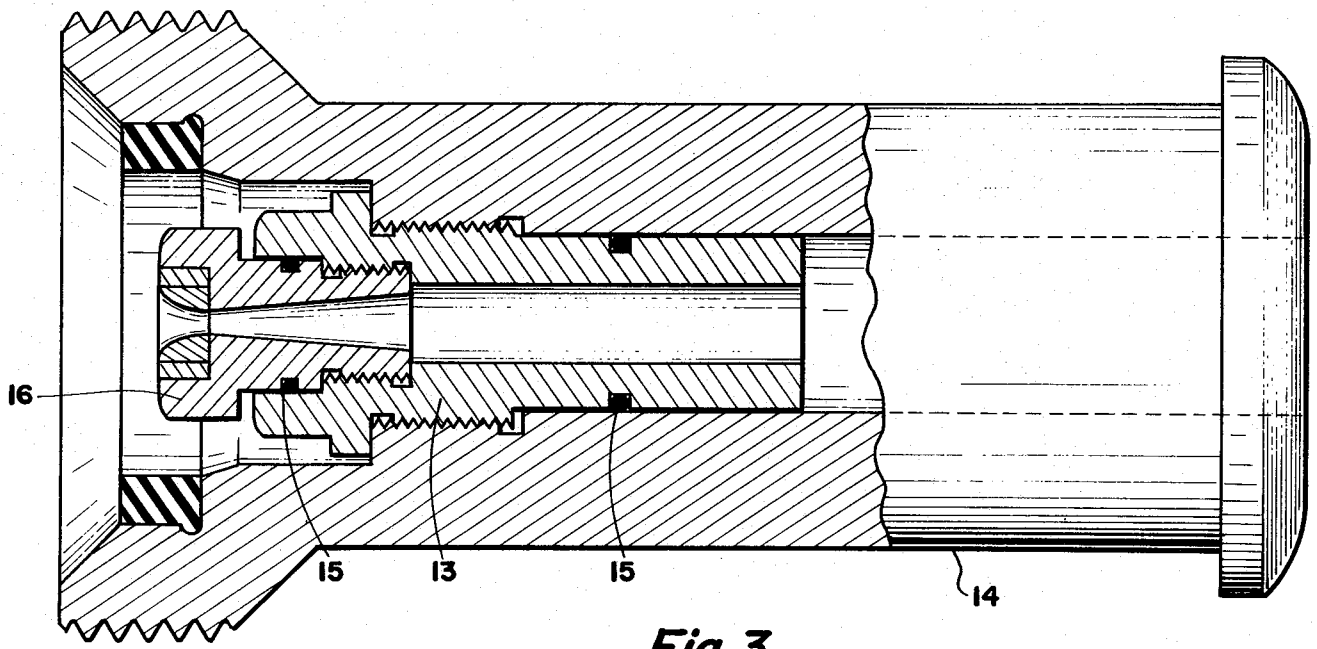
FIG. 3 shows a side schematic cross-sectional view of a choke nipple containing a choke adapter which in turn contains the choke flow bean.

The choke nipple (14) shown in FIG. 3 is also a hollow housing having internal threads within its bore for engaging the choke adapter. The choke nipple has a hollow bore at its discharge end for receiving fluids discharged from the choke flow bean/choke adapter and it usually has means at the inlet end for fixedly engaging it in fluid communication with a source of pressurized fluid. The choke nipple may be of various materials of construction, but it is usually designed to withstand high pressure and is normally metal (e.g., steel).

Fluid sealing means (15), such as elastomeric "o-rings" are desirable in many instances, and are depicted in FIG. 3.

Figure 1:
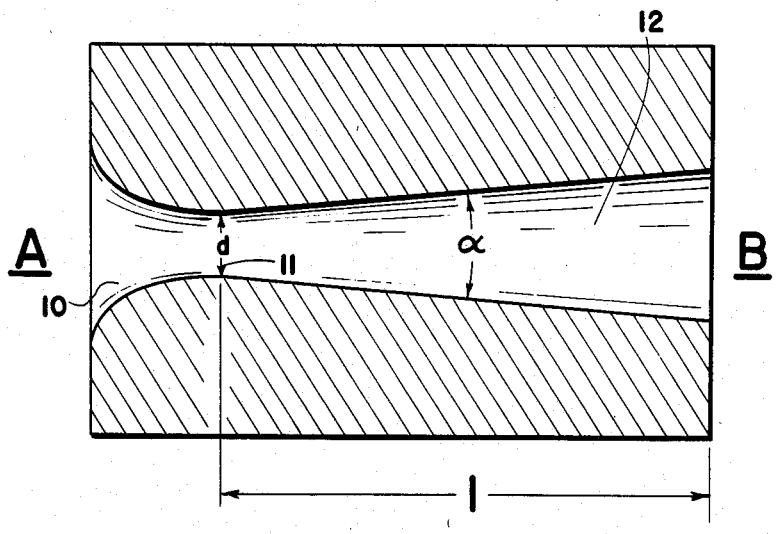
FIG. 1 shows a side schematic cross-sectional view of the choke flow bean.

The choke flow bean illustrated by FIGS. 1 and 2 was embodied in a choke nipple as per FIG. 3 and used in the choke assembly by Zingg et al. (Ser. No. 185,087 filed Sept. 8, 1970). This choke flow bean is used in a slurry concentrator described by Zingg (Ser. No. 185,065, filed Sept. 8, 1980 and now U.S. Pat. No. 4,354,552 issued Oct. 19, 1982) during the high pressure fracturing of a well. The disclosures of U.S. Ser. No. 185,087 and Ser. No. 185,065 are incorporated herein by reference. The throat of the choke flow bean was a tungsten carbide insert and the remainder of the choke flow bean was carburized steel. The choke flow bean showed little or no signs of wear after 8 hours of use in which the fluid was pressurized through the choke flow bean at over 10,000 psi. When the choke flow bean of the instant invention was replaced with a conventional commercial choke flow bean of ceramic construction, the ceramic choke flow bean destructed in less than 20 minutes.

In another instance, a well had been hydraulically fractured using a foam fracturing fluid and was highly pressurized with gaseous nitrogen and gases within the well. The well was valved off, the choke nipple containing the choke adapter and choke flow bean (as per FIG. 4) was attached, and the valve to the well reopened. The gases emitted from the well were at several thousand psi and would normally have destroyed ceramic choke flow beans within a matter of minutes but the choke flow bean (as detailed above) showed little or no signs of wear during the course of bleeding off the well pressure. The gases and liquids emitted from the well were safely discharged into conventional piping without undue erosion.

What is claimed is:

1. A removable and replaceable choke flow bean capable of reducing the pressure of abrasive fluids under high pressure passing therethrough, comprising:

a housing having a first end and second end defining a bore of generally circular cross section which extends, along with its axis of generation, from the first end to the second end, the external portion of the first end of the housing having a surface adapting it as a wrench-engaging fitting, the external portion of the second end of the housing having connecting means for operatively securing it to a choke nipple and separately applied sealing means for preventing the high pressure fluid from passing along the external portion of the choke flow bean, said sealing means being spaced from said connecting means, the bore being of varying diameter along its axis of generation with regions of larger diameter adjacent the first and second ends of the housing, a region of minimum diameter d, intermediate the first and second ends, the bore having a general configuration approximating that of a trumpet bell between the first end and the region of minimum diameter wherein the radius of curvature of the wall is about 0.5d to 1.0d and is an abrasion-resistant material, said trumpet bell formed by an insert at said first end within said housing, said insert having its bore at the end closest to said second end adjacent said region of minimum diameter and being substantially equal thereto in diameter, the bore having a frustoconical configuration between the second end and the region of minimum diameter with a total included angle of from about 4° to about 8° and having a length along the axis of generation of about 9d between the region of minimum diameter and the second end, whereby the choke flow bean causes a substantial reduction in pressure of the high pressure abrasive fluid at its minimum diameter without substantial turbulence or cavitation while resisting wear and being readily replaceable.

2. The choke flow bean defined by claim 1, wherein the total included angle is from about 5° to about 7°.

* * * * *